United States Patent [19]

Parr

[11] Patent Number: 4,585,286

[45] Date of Patent: Apr. 29, 1986

[54] UNIVERSAL ELECTRICAL PLUG ADAPTER

[76] Inventor: Darrell Parr, 3195 Heights Dr., Reno, Nev. 89503

[21] Appl. No.: 762,419

[22] Filed: Aug. 5, 1985

[51] Int. Cl.[4] ..... H01R 29/00

[52] U.S. Cl. ..... 339/31 M; 339/32 M; 339/31 R

[58] Field of Search ..... 339/31 R, 31 M, 32 R, 339/32 M, 14 D, 14 T, 154 A, 155 T, 156 T, 195 A, 196 A

[56] References Cited

U.S. PATENT DOCUMENTS 2,692,979 10/1954 Withey, Jr. ..... 339/31 R
2,994,849 8/1961 Mussari, Jr. ..... 339/32 M
3,730,971 5/1973 Durham et al. ..... 339/31 R
3,851,243 11/1974 Banner ..... 339/32 R

FOREIGN PATENT DOCUMENTS 572903 2/1924 France ..... 339/156 T
608860 9/1960 Italy ..... 339/31 R

*Primary Examiner*—Gil Weidenfeld
*Assistant Examiner*—Paula A. Austin

[57] ABSTRACT

An electrical adapter converts a three-prong male household plug to a three-prong male OSHA twistlock connector, and vice versa.

1 Claim, 4 Drawing Figures

UNIVERSAL ELECTRICAL PLUG ADAPTER

BACKGROUND OF THE INVENTION

1. Field of the Invention

This invention relates to an electrical adapter and more particularly to a three-prong grounding adapter for adapting three-prong household plugs to OSHA three-prong twistlock connectors.

2. Brief Summary of the Invention

Several different systems of three-prong electrical connectors are in current use for low-power single-phase appliances. It sometimes is necessary to make electrical connections between electrical outlets, power cables and electrical appliances having different types of prongs which are incompatible with each other. It is an object of this invention to provide an adapter for interconnecting three-prong grounding household connectors and OSHA (Occupational Safety and Health Administration) three-prong twistlock connectors.

DETAILED DESCRIPTION

Figure 1:
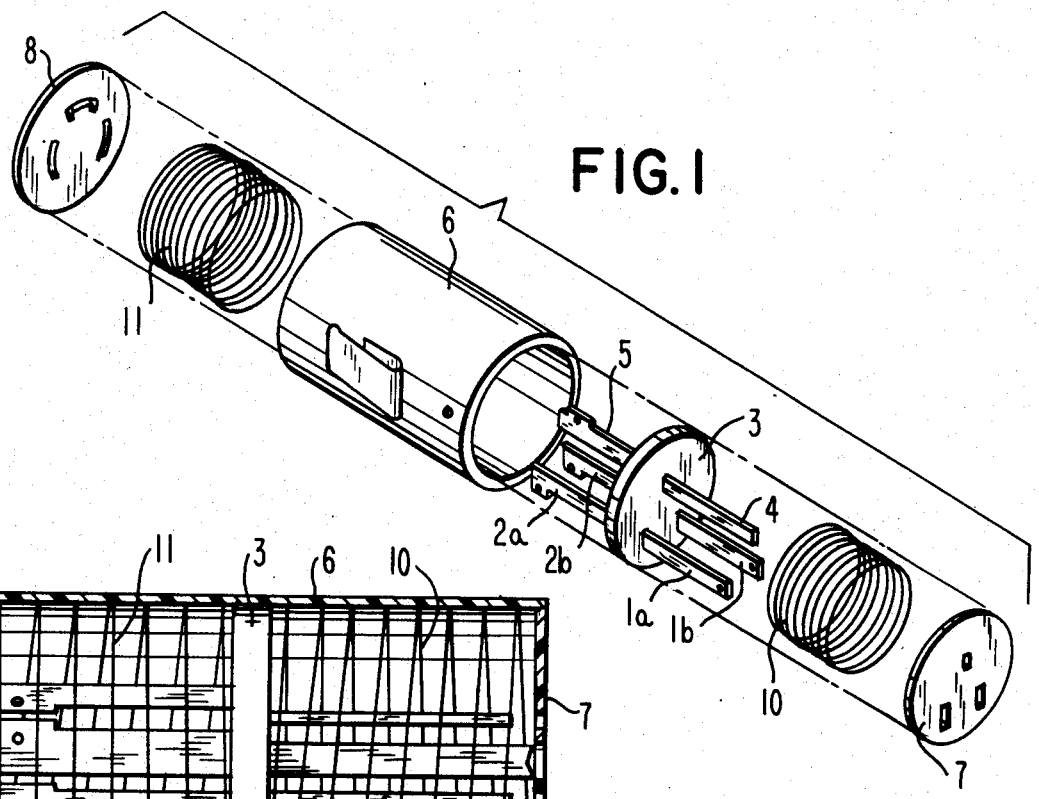
FIG. 1 is an exploded perspective view of a universal plug adapter shown in accordance with the present invention.
Figure 2:
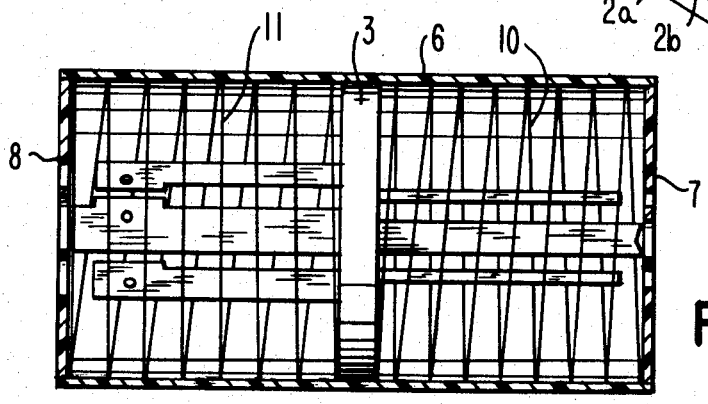
FIG. 2 is a cross-sectional view of the embodiment of the invention shown in the retracted position.

As illustrated by the exploded view of the invention in FIG. 1, electrical male household prongs 1*a*and 1*b* are electrically connected to male OSHA prongs 2*a* and 2*b*, respectively, through an insulating block 3. Ground prong 4 on the household plug is electrically connected to ground prong 5 on the OSHA plug through the insulating block 3. The assembly comprising the prongs and the insulating block is housed in a hollow cylindrical housing 6 and is free to slide back and forth therein. On the side of the household plug, there is provided an end plate 7 with openings matching the pattern of a three-prong household plug, and the end plate 7 is secured to the end of the housing 6. On the side of the OSHA plug, there is similarly provided an end plate 8 having openings matching the pattern of a three-prong OSHA plug, this end plate being secured to the opposite end of the housing 6. To prevent rotation of the prong assembly within the housing, the household prongs are guided by alignment clips 9 which are fastened to the end plate 7, which are made of a nonconducting material, and within which the household prongs are free to slide back and forth.

Two coil springs 10 and 11 are disposed inside the housing 6, spring 10 between the end plate 8 and the insulating block 3, and spring 11 between the end plate 7 and the insulating block 3.

Figure 3:
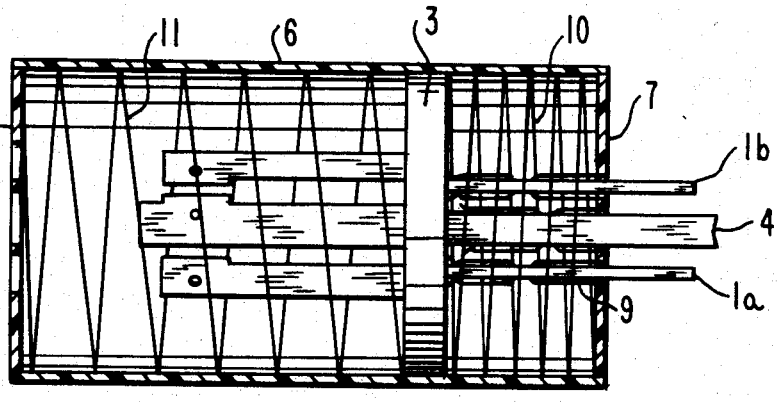
FIG. 3 is a cross-sectional view with the male household prongs extended.
Figure 4:
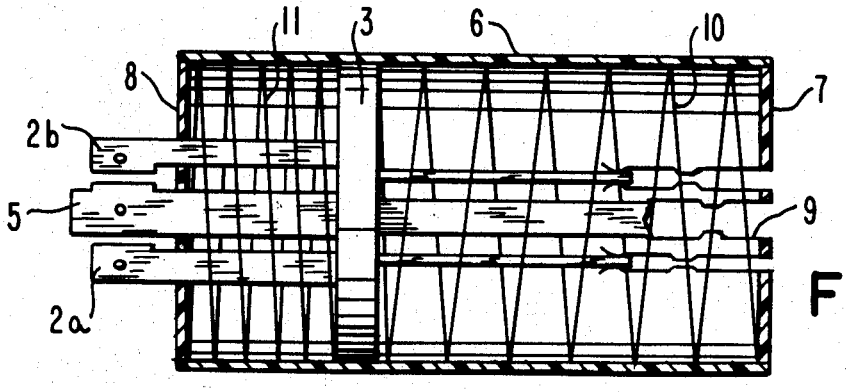
FIG. 4 is a cross-sectional view with the male OSHA prongs in the extended position.

Referring to FIG. 3, when an OSHA male plug is connected to the adapter, being inserted through the openings in end plate 8, the prong assembly is pushed toward the end plate 7 and the household prongs 1*a*, 1*b* and 4 protrude from the openings in end plate 7. Referring to FIG. 4, when a household male plug is inserted through the openings in end plate 7, the prong assembly is pushed toward the end plate 8 and the OSHA prongs 2*a*, 2*b* and 5 protrude from the openings in end plate 8. A male OSHA plug is thus converted to a male household plug, and vice versa.

While various changes may be made in the detail construction, it is understood that such changes will be within the spirit and scope of the present invention, as is defined by the appended claims.

What I now claim is:

1. An electrical plug adapter for adapting a male three-prong electrical household plug to a three-prong male OSHA twistlock plug, and vice versa, comprising a set of two male power prongs and a ground prong arranged in accordance with the pattern used for household appliances, and a set of two male power prongs and a ground prong arranged in accordance with the pattern used for OSHA twistlock connectors, the power prongs on the household plug being electrically connected to the power prongs on the OSHA plug, and the ground prong on the household plug being connected to that on the OSHA plug, the connections between said prongs being embedded in an insulating block, the assembly of prongs and insulating block being disposed in a hollow cylindrical housing made of a nonconducting material, being free to slide back and forth therein, said assembly being restrained from rotation within said housing by alignment clips fastened to a first end plate, said alignment clips grasping the prongs of the household plug, said first end plate being secured to the end of the hollow cylindrical housing, and a second end plate, being secured to the opposite end of the housing, there being openings in the first end plate corresponding to the pattern used for three-prong electrical plugs for household appliances, and openings in the second end plate correspondent to the pattern used for three-prong OSHA connectors, and a coil spring in the space between the insulating block and the first end plate, and a second coil spring in the space between the insulating block and the second end plate, whereby the movement of the prong assembly within the housing is restrained.

* * * * *